US006793026B1

(12) United States Patent
De Fazio

(10) Patent No.: US 6,793,026 B1
(45) Date of Patent: Sep. 21, 2004

(54) WALL-CLIMBING ROBOT

(75) Inventor: Thomas L. De Fazio, Watertown, MA (US)

(73) Assignee: i Robot Corporation, Burlington, MA (US)

( * ) Notice: Subject to any disclaimer, the term of this patent is extended or adjusted under 35 U.S.C. 154(b) by 123 days.

(21) Appl. No.: 10/022,037

(22) Filed: Nov. 27, 2001

Related U.S. Application Data

(60) Provisional application No. 60/253,158, filed on Nov. 27, 2000.

(30) Foreign Application Priority Data

Aug. 22, 2000 (JP) ..... 2000-251109

(51) Int. Cl.[7] ..... B60B 15/00

(52) U.S. Cl. ..... 180/8.3; 180/901; 280/5.26; 305/4

(58) Field of Search ..... 280/5.2, 5.24, 280/5.26, DIG. 10; 180/164, 8.1, 8.2, 8.3, 8.5, 8.6, 8.7, 901, 167; 305/1, 2, 3, 4, 5, 7; 446/177, 353, 431, 445, 405

(56) References Cited

U.S. PATENT DOCUMENTS

| | | | | | |
|---|---|---|---|---|---|
| 2,664,962 | A | * | 1/1954 | Faszvzuk | 180/195 |
| 3,411,599 | A | * | 11/1968 | Kahlmorgan et al. | 180/8.2 |
| 3,529,479 | A | * | 9/1970 | Ryan et al. | 74/154.4 |
| 3,696,727 | A | * | 10/1972 | Yokozato | 396/263 |
| 3,845,831 | A | * | 11/1974 | James | 180/8.7 |
| 4,477,998 | A | | 10/1984 | You | |
| 4,492,058 | A | | 1/1985 | Goldfarb et al. | |
| 4,618,213 | A | | 10/1986 | Chen | |
| 4,764,148 | A | | 8/1988 | Wong | |
| 4,884,989 | A | | 12/1989 | Wong | |
| 4,971,591 | A | | 11/1990 | Raviv et al. | |
| 5,062,819 | A | | 11/1991 | Mallory | |
| 5,094,311 | A | * | 3/1992 | Akeel | 180/119 |
| 5,551,525 | A | | 9/1996 | Pack et al. | |
| 5,809,099 | A | | 9/1998 | Kim et al. | |
| 5,839,532 | A | | 11/1998 | Yoshiji et al. | |
| 5,890,553 | A | * | 4/1999 | Bar-Cohen et al. | 180/81 |
| 5,916,008 | A | | 6/1999 | Wong | |
| 6,036,572 | A | | 3/2000 | Sze | |
| 6,099,091 | A | * | 8/2000 | Campbell | 305/4 |
| 6,276,478 | B1 | | 8/2001 | Hopkins et al. | |
| 2002/0179342 | A1 | * | 12/2002 | Quinn et al. | 180/8.1 |

FOREIGN PATENT DOCUMENTS

| | | | | |
|---|---|---|---|---|
| FR | 1110774 | * | 2/1956 | 305/4 |
| JP | 59-18072 | * | 1/1984 | |
| JP | 1-160785 | * | 6/1989 | |
| SU | 0683738 | * | 9/1979 | 280/5.26 |

* cited by examiner

*Primary Examiner*—Anne Marie Boehler
(74) *Attorney, Agent, or Firm*—Testa, Hurwitz & Thibeault, LLP

(57) ABSTRACT

A wall-climbing robot or mobility platform able to ascend and descend various horizontal and vertical surfaces having a chassis, a rotor rotatable with respect to the chassis, one or more prominences on the rotor, and means for adhering to a surface attached to the prominences. The robot is able to make a transition from horizontal travel to vertical travel. In certain embodiments, the means for adhering to a wall is a pressure sensitive adhesive. In addition, multiple rotor configurations and radio-control are used for remote operation.

46 Claims, 8 Drawing Sheets

WALL-CLIMBING ROBOT

CROSS REFERENCE TO RELATED APPLICATIONS

This application claims the benefit of U.S. Provisional Application Serial No. 60/253,158, filed Nov. 27, 2000.

STATEMENT AS TO FEDERALLY SPONSORED RESEARCH

This invention was made in part with Government support under contract N000014-98-C-0183 awarded by the Defense Advanced Research Projects Agency. The Government may have certain rights in the invention.

BACKGROUND OF THE INVENTION

The invention relates to a mobile robot or mobility platform capable of climbing walls.

A number of wall climbing and descending designs exist in the prior art, including designs within the novelty and toy industries. For example, a number of toys have been designed to adhere to walls while passively descending. For example, U.S. Pat. No. 4,764,148 discloses a toy having a roller coated with a polymer material of sufficient tackiness to allowing the roller to stick to a wall as it descends. A similar toy is disclosed in U.S. Pat. No. 5,916,008. These toys have significant limitations. First, neither toy is able to ascend a wall. Second, neither toy can remain positioned in a static location on a wall. Finally, these toys cannot make a transition from wall-to-floor or from floor-to-wall.

Similarly, toys have been proposed for ascending walls. For example, U.S. Pat. No. 4,477,998 discloses a wall-climbing toy consisting of a series of suction cups mounted on an endless belt. U.S. Pat. No. 4,971,591 discloses a vehicle, not necessarily a toy, that employs a powered vacuum and suction cup arrangement to allow the vehicle to ascend or descend a smooth and non-porous surface. Likewise, U.S. Pat. No. 6,036,572 discloses a toy with a pair of robotic limbs each with a resilient sucker for climbing virtually smooth walls. These toys are significantly limited as to the surfaces on which they can operate. Moreover, these toys cannot make a transition from wall-to-floor or from floor-to-wall.

Climbing robots have also been suggested for tasks unrelated to amusement. U.S. Pat. No. 5,809,099 discloses an underwater wall-climbing robot used in specialized conditions. The robot uses magnetic wheels, thus limiting its climbing operations to ferrous walls. In addition, U.S. Pat. Nos. 5,551,525, 5,839,532 and 6,276,481 each disclose a vacuum (powered suction cup) apparatus able to climb smooth and non-porous walls.

As seen the prior art, many wall attachment mechanisms have been used, most commonly suction cups and magnets. These means of adhesion tend to limit the wall surfaces on which each design can be used. For example, magnets are only effective on ferrous surfaces, and suction cups or vacuum designs require a relatively smooth and non-porous surface in order to maintain an appropriate seal.

While the preferred embodiments discussed herein are primarily designed as toys, the robots or mobile platforms of the present invention are able to transverse a number of obstacles. A robot built on such a mobile platform can be used to perform any number of useful tasks including search & rescue, surveillance, environmental monitoring, entry into or placing sensors into restricted or convoluted spaces.

SUMMARY OF THE INVENTION

The present invention provides a modified and improved mobility means able to climb walls. In accordance with the present invention a wall-climbing robot comprises a chassis, including an axle mounted substantially normal to the fore-aft centerline of the chassis, a rotor rotatable with respect to the chassis and attached to the axle, the rotor further comprising a prominence, a foot attached to the prominence further comprising a means for adhering to a surface, and an active drive means.

It is an object of the present invention to provide a robot or mobile platform able to ascend and descend a vertical surface.

It is an object of the invention to provide a robot that is able to make a transition from the horizontal plane (e.g. floor) to the vertical plane (e.g. wall).

It is an object of the invention to provide a robot able to climb walls constructed from any number of materials including porous or rough walls.

It is an object of certain embodiments of the invention to provide a robot able to traverse rough and uneven terrain independent of robot size or terrain features.

It is an object of certain embodiments of the present invention to provide a remotely controlled robot able to ascend or descend a vertical surface.

It is an object of certain embodiments of the invention to provide a robot able to operate top-away (i.e. erect) from a surface, or top-toward (i.e. upside-down) that surface.

Other features and advantages of the invention will be apparent from the following detailed description, and from the claims.

DETAILED DESCRIPTION

Figure 1:
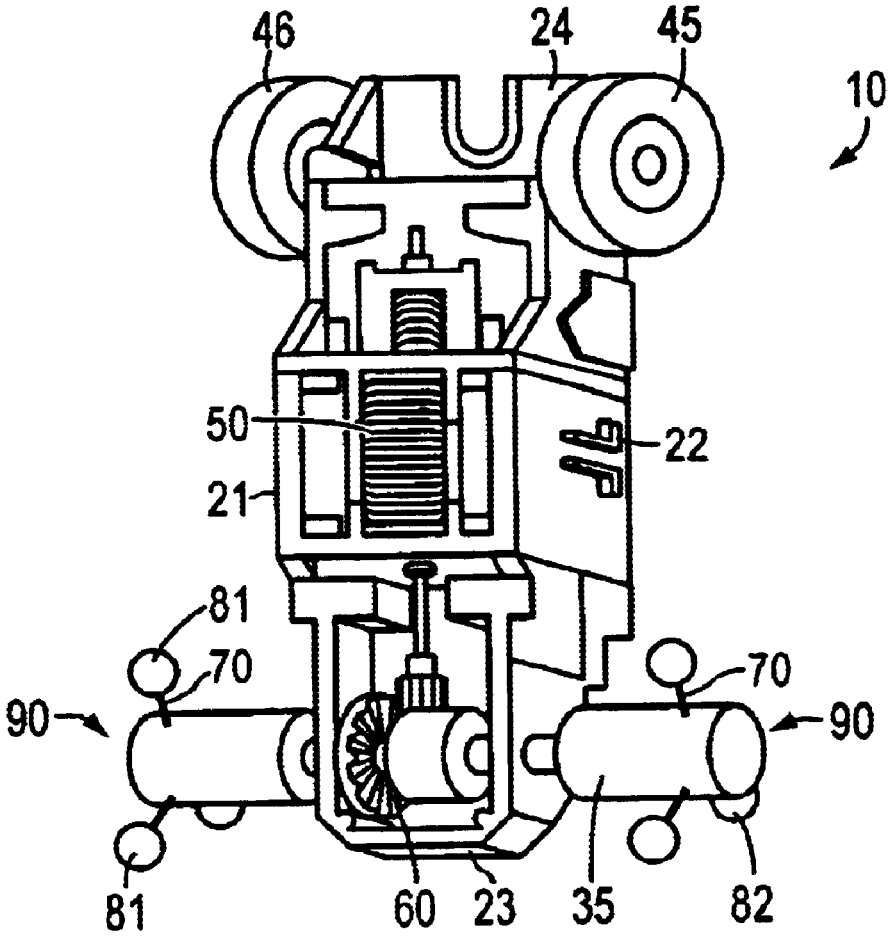
FIG. 1 shows an isometric view of an embodiment of the robot according to the invention.

FIG. 1 shows the quasi-legged, rotary drive platform 10, which is a preferred embodiment of the present invention.

Referring to FIG. 1, the preferred embodiment of the invention is a robot 10, comprising a chassis 20 with a forward axle 30 and a rear axle 40. The chassis 20 consists of upstanding right and left side walls 21 & 22, respectively, and front end wall 23 and rear end element 24. The chassis 20 also comprises a motor 50 and gearing 60 operatively connected to motor 50 to provide power to forward axle 30. The chassis 20 serves to support the elements described herein. In one embodiment, the design for the chassis, motor, gearing and rear wheels are taken from a standard toy slot car, with power and control provided remotely from wires 55. While the embodiments described herein are each powered by a DC motor, alternative embodiments may be powered by electrical or spring motors, or other power sources known in the art.

In the preferred embodiment, at the end of each end of the forward axle 40, a rotor 90 is attached. As described in detail below, the rotor 90 of the preferred embodiment comprises a hub 35, legs 70 and adhesive feet 81 & 82. In other embodiments, the rotors need not contain these elements.

In a preferred embodiment of the platform 10, the chassis 20 is approximately 5 cm long from the front end wall 23 to the rear end element 24 and 2 cm wide from the right side wall 21 to the left side wall 23. The left feet 82 and the right feet 81 are approximately 4.5 cm apart, and the centermost portions of the rear wheels 45 & 46 are 2.7 cm apart. The preferred embodiment shown in FIGS. 1–3 weighs approximately 18 grams without an on-board battery. As will be understood by one of skill in the art, the overall weight of the vehicle should be minimized. While in theory the robot can be scaled to any size and weight provided an appropriate increase in power and adhesive properties, the present invention is sensitive to scaling limitations.

Figure 2:
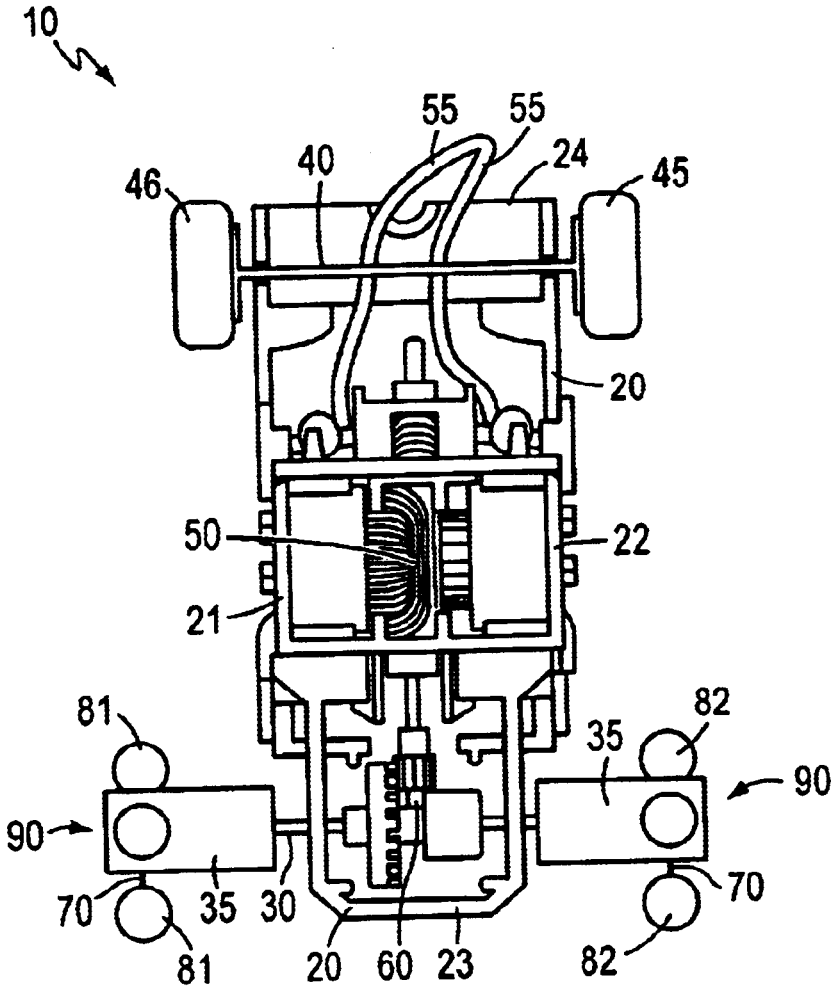
FIG. 2 shows a top view of the embodiment shown in FIG. 1.
Figure 3:
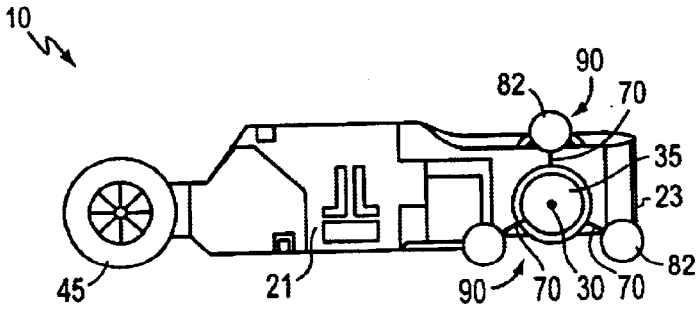
FIG. 3 shows a side view of the embodiment shown in FIG. 1.

In the preferred embodiment shown in FIGS. 1–3, the rear wheels 45 & 46 are connected to each end of the rear axle 40, which is rotatably connected to the chassis 20. In the embodiment shown in FIGS. 1–3, the rear axle 40 is unpowered and turns freely in either direction. In other embodiments with a rear axle, the rear axle may be powered. The rear wheels 45 & 46 in the embodiment shown also comprise tires made of rubber or a hard engineering thermoplastic and are approximately 1 cm in diameter.

As shown most clearly in FIG. 3, rotor 90 comprises three legs 70 equispaced around hub 35 such that 120 degrees separates each leg 70. In the preferred embodiment, each leg is approximately 5 mm from the hub 35 to the end. The particular length of legs 70 is chosen to address any of various criteria. Specifically, short legs minimize the load on the drive train, while longer legs may be necessary to provide sufficient chassis-to-surface clearance.

In the preferred embodiment, the legs 70 are constructed from carbon steel wire (music wire) of approximately 0.6 mm in diameter. The legs 70 are designed to support and hold the adhesive feet 81 and 82, to provide sufficient clearance between the chassis 20 and any surface that is to be operated over, and to accept the drive torque of the drive train without significant bending deflections or "wrap-up" of the legs. The adhesive feet are to be sufficiently securely attached to the legs so as to not separate under driving load. One of skill in the art will be able to choose any number of suitable materials that addresses the above needs and criteria. Moreover, one of skill in the art will recognize that the number of legs is limited only by the performance characteristics of the particular design. Each preferred embodiment herein comprises three legs 70, and in turn three feet 81 or 82, per rotor 90. One of skill in the art will recognize that the more feet 81 or 82 per rotor 90, the smoother the robot's gait; and the fewer feet per rotor, the more secure the wall attachment of the next foot to make contact with the surface and the harder to lift off the previous foot making contact with the surface.

By way of explanation, the initial adhesion of a foot to a surface increases with increasing impact velocity of a foot against a surface. With a fixed value of drive torque, a fixed rotor radius, and equal angular spacing from foot to foot, impact velocity increases with elapsed time between the lifting of the rear foot (of what had been two contacting feet), and the impact of the new forward foot. Thus, impact velocity increases with angular spacing between feet on a rotor, or increases as foot count per rotor decreases.

The greater the initial adhesion, the better the initial security of the robot or platform on the surface; but, also, the greater the initial adhesion, the harder it is to lift off the rear foot to take the next step.

The gait of the platform depends on the foot count per rotor. With equal angular spacing between feet, the more feet there are on a rotor, the closer the rotor approximates a round wheel, and the closer the platform's motion approaches a smooth rolling motion. The gait of a platform also depends on the angular spacing between feet on each rotor, yielding a syncopated gait if the spacing is unequal from foot to foot on a rotor. The gait of a platform with two rotors also depends on the angular phasing between the rotors. Assuming forward motion only, if the phase angle is zero, i.e. the rotors in phase, the platform will pitch but not roll; if the phase angle is non-zero, the platform will also roll; if the phase angle splits (is one half of) of the angular spacing between feet on a rotor, then the rolling gait will have a symmetry, while if the phase angle is different, the rolling gait will have a syncopation. Each of these design variables—foot count, angular spacing and rotor phasing—provide a robot with differing characteristics, and are left to the desired characteristics of a particular embodiment.

In order to balance these concerns, in the preferred embodiment, the two sets of three feet each are mounted on a rigid axle 60 degrees out of phase from one another. By having the wheel-to-wheel phase angle split the leg-to-leg (foot-to-foot) angle on a hub, the gait is even. This even gait also evenly splits the foot attachment force from side-to-side maximizing the robots ability to maintain contact with a vertical surface.

In the embodiment shown, at the end of each leg 70, a spherical foot 81 or 82 is attached. The feet 81 and 82 are chosen for their adhesion characteristics, which are discussed in detail below. In the preferred embodiment, each spherical foot is approximately 5 mm in diameter.

In the preferred embodiment, the means for attaching to the wall are feet 81 & 82 made of re-usable hot melt adhesives such as National Starch and Chemical Company's Instant Lok™ 34-2602, which is able to adhere to metals, glass, plastics, clean wall-board, paper, and painted surfaces. In the preferred embodiment, the adhesive feet, or those surfaces of the robot's drive rotors 90 that contact wall surfaces, are to be of materials commonly called "pressure-sensitive adhesives." The salient feature of such adhesives, for purposes of these embodiments, does relate to the surfaces being operated over, and is an adhesive that has a (significantly) larger pull-off force off the operating surface than its initial contact force against the operating surface. It is noted that the adhesive properties of re-usable hot-melt adhesives may become diminished as dirt and/or other particulate matter sticks to the adhesive. In the preferred embodiment, the adhesive can be re-heated to maximize adhesive properties. Alternative adhesive materials are well known in the prior art.

In the preferred embodiment, the feet were molded using the following process:

1. Pre-heat oven to 375–400 degrees F.;
2. Heat mold, leg and C-clamp to nominal 375–500 degrees F.;
3. Heat adhesive polymer to nominal 375–400 degrees F.;
4. Turn oven off and immediately pour the polymer into the mold and return the leg, mold and C-clamp with poured foot to the oven;
5. Allow the oven and its contents to cool;
6. Slowly split the mold at about 120–150 degrees F., at which temperature the polymer will no longer flow yet the foot will be easier to remove from the mold, carefully removing the foot from a mold-half; and
7. Store the completed leg/foot in a clean place.

While this procedure was used for the preferred embodiment, one of skill in the art can adjust the following procedure for the particular materials used.

In addition, one of skill in the art will recognize that alternative means of adhesion are available. For example, in an alternative embodiment, small, passive suction cups or mechanical means such as claws or talons can be used. It will be recognized that it may be beneficial to choose a purely passive means of adhesion such that continuous power consumption is not required to maintain attachment to the wall. In the preferred embodiments discussed herein, to maintain attachment to a wall without moving, i.e. not climbing and not descending under control, requires torque to counter the weight of the robot and to keep the foremost feet from peeling off the wall. This requires a minimum amount of power to be applied to the motor or motors. Due to the nature of the adhesives used on the preferred embodiments disclosed herein, to maintain in a particular region of the wall for an extended period of time, it may be necessary to have the robot rocker back and forth between a controlled free-wheel descent and a powered climb. In certain embodiments the rocker motion can be programmed to occur in the absence of any other signal to the motors.

FIGS. 4–7 show an alternative embodiment of the present invention designed to contain components to allow for remotely-controlled operation. The robot 100 contains chassis 120, right forward axle 131, left forward axle 132, rear axle 140, rear roller 145, motors 151 & 152, on-board battery 190, radio receiver 210, and motor controller 220. The chassis 120 of the robot—constructed of engineering thermoplastic, such as Delrin™, in the preferred embodiment—contains numerous carve-outs that serve both to allow the electronic components, including the batteries 190, to fit within the chassis 120 and to minimize the overall weight of the robot 100. The chassis 120 of the preferred embodiment is approximately 10 cm long.

In the embodiment shown in FIGS. 4–7, the right rotor 191 (with its right legs 171) is driven independently from the left rotor 192 (with its left legs 172), giving the robot a second degree of freedom and the ability to turn. Each rotor 191 & 192 is driven by a motor/gearbox combination. In the preferred embodiment a 9V DC Motor is used, such as a small 10 mm Maxon motor with corresponding Maxon in-line planetary gearheads (RE-10 118398 Motor; gearheads include 110309 at a 16:1 ration and 110310 at a 64:1 ratio).

On-board power is provided in battery 190, such as one or more standard lithium cells. The robot 100 uses three Duracell DLCR2 Li—$MnO_2$ 2-volt lithium cells. While in this embodiment the right and left rotors 191 & 192 are each driven directly off the motors 151 & 152, respectively, in other embodiments different means of power transmission may be used.

Figure 4:
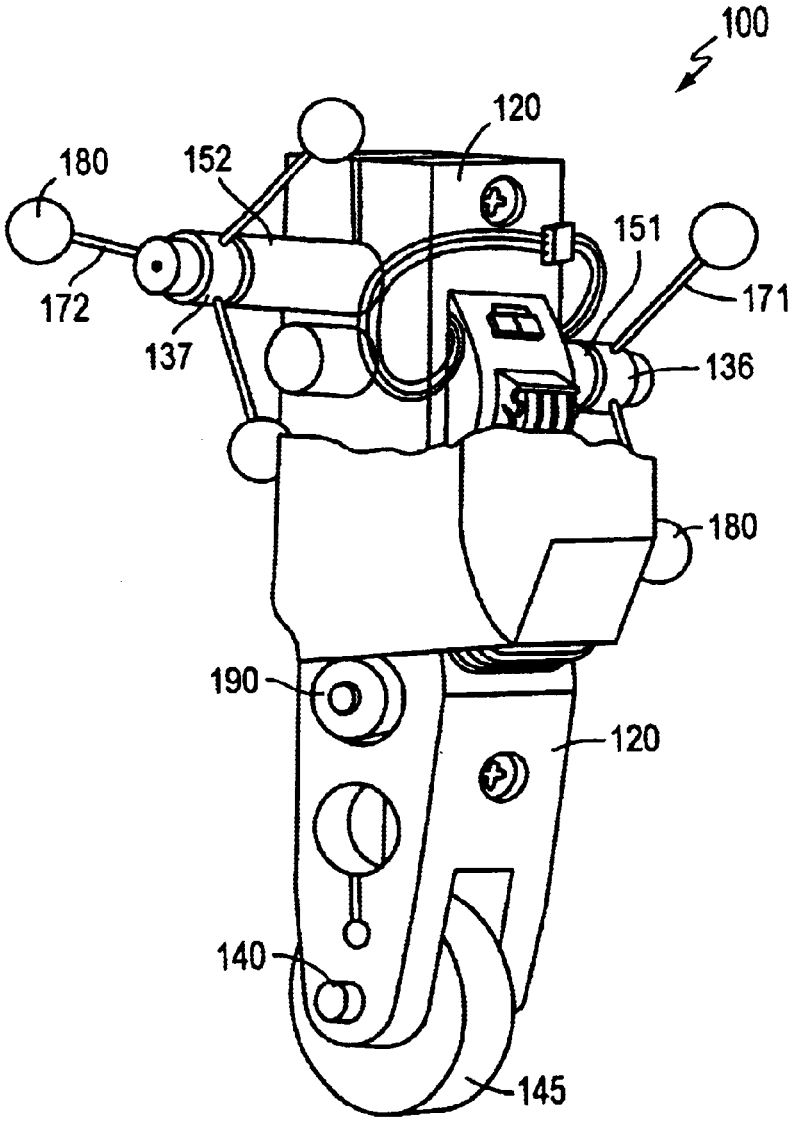
FIG. 4 shows an alternative embodiment of a radio-controlled wall-climbing robot.

In the embodiment shown in FIG. 4, the left and right drive axles are offset, with the left drive axle positioned towards the front of the chassis 120 and the right drive axle positioned just aft of the left drive axle. This offset is an accommodation to minimizing the overall robot size and weight for an available set of motors and gearheads.

While this embodiment uses independently controllable drive rotors for steering, other means for steering are well known in the art, including articulation between fore and aft legs.

Wall-climbing robot 100 contains electronic components necessary for remote operation, including a radio receiver 210, such as Sky Hooks & Rigging's SHR-RX72 PRO, and a bi-directional 2-motor controller, such as Sky Hooks & Rigging's Micro 5B1. The particular components should be chosen not only for their performance capabilities but also based on particular size and weight requirements. In the preferred embodiment, the smallest possible electronics were selected.

Robot 100 also has a single idler rear wheel or roller 145 located near the rear of the chassis 120. This roller spins freely about rear axle 140. In this particular embodiment, the roller 145 is constructed of polycarbonate with an aluminum insert, which was chosen for its lightweight and ease of machinabiliy properties. In other embodiments, the rear wheel can be powered and can be made from any number of materials, including materials with adhesive properties. In the alternative, a tread could be fitted about the rear idler. In the preferred embodiment, the aft roller acts to minimize frictional impedance of the robot's progress, and therefore no adhesive material is used. A similar purpose can be met with a skid or other element known in the art.

Although the rotors 191 & 192—with hubs 136 & 137, legs 171 & 172 and feet 180—of robot 100 are similar to those used in the robot 10 shown in FIGS. 1–3, the legs 171 & 172 of robot 100 in the embodiment of FIG. 4 are substantially longer than the legs 70 of FIGS. 1–3, with a foot circle radius of approximately 2.25 cm. In the embodiment shown, feet 180 are approximately 60 mm in diameter.

Figure 5A:
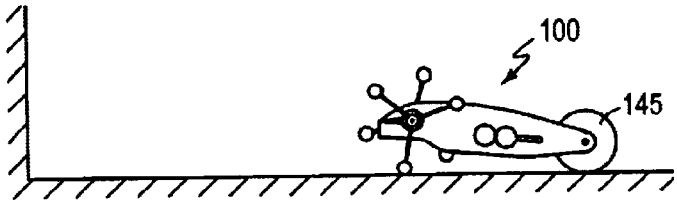
FIGS. 5A–D shows the robot shown in FIG. 4 transitioning from horizontal motion to vertical motion.
Figure 5B:
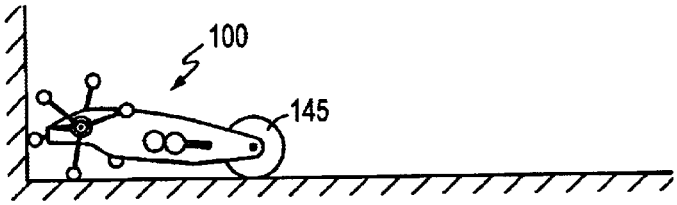
Figure 5C:
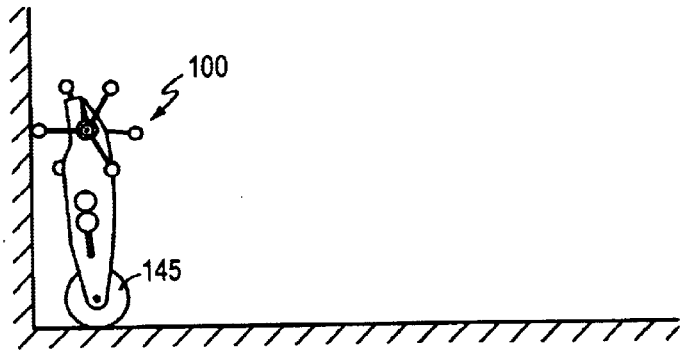
Figure 5D:
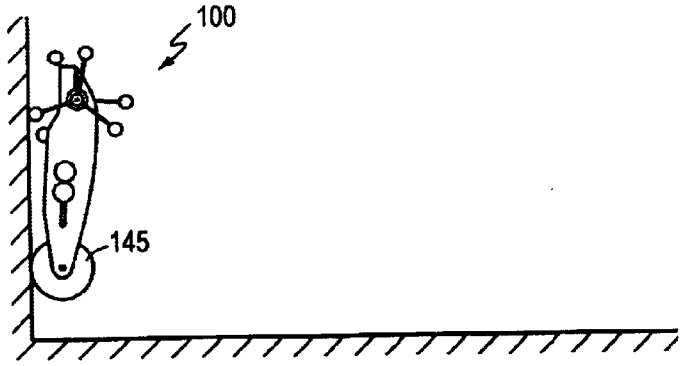
Figure 6:
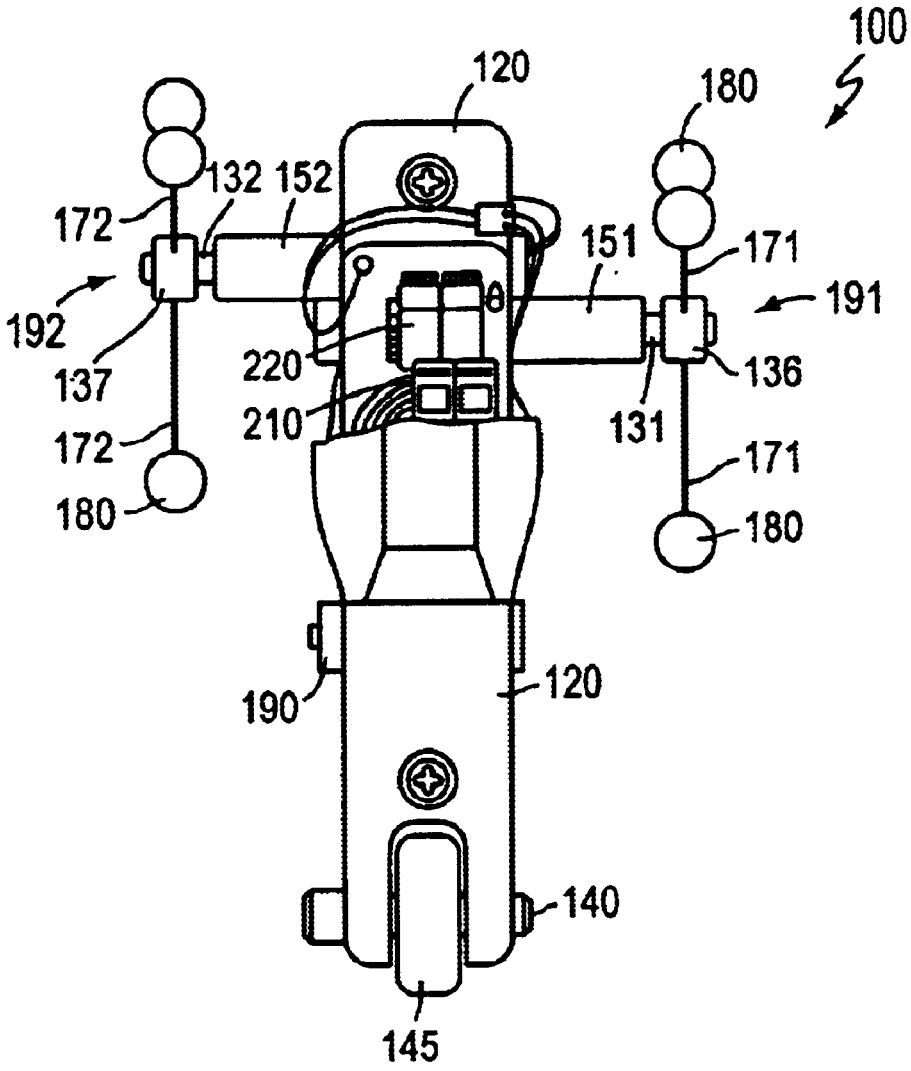
FIG. 6 shows a top view of the embodiment shown in FIG. 4.
Figure 7:
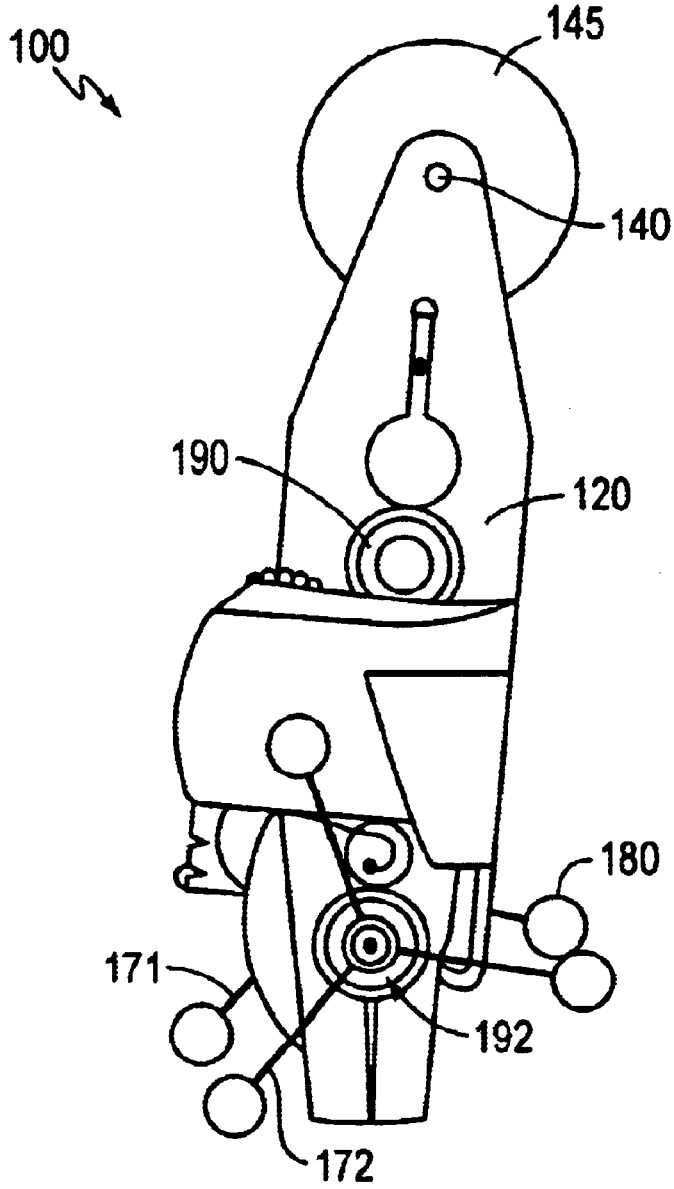
FIG. 7 shows a side view of the embodiment shown in FIG. 4.

In order for the robot 100 to be able to make a transition from the floor to the wall, the proper dimensions of wheelbase, foot circle radius and leg count must be chosen. FIGS. 5A–D shows a schematic representation of the remote-control robot 100 of FIG. 4 making a transition from horizontal travel to wall climbing. In FIG. 5A, the robot 100 is able to travel along the floor and approach the wall. At any one moment only one or two feet on each rotor is in contact with the floor, along with rear wheel 145. In FIG. 5B, the robot 100 comes into contact with the wall; in FIG. 5C the robot begins to climb the wall supported by both the adhesive properties of the feet and the rear roller 145. Finally, in FIG. 5D, the robot 100 is fully supported by the adhesive properties of the feet and is able to ascend the wall.

While the robot 100 is designed to be able to make a transition from floor to wall (as shown in FIG. 5), it is possible for the robot 100 to get into an awkward, stable position wherein all three feet of one rotor contact an essentially flat surface, e.g. wall, floor, or adjacent wall. In this situation, the rotor may stick flat to the surface and the entire platform may spin about the stuck rotor. This issue can be addressed by extending the axle beyond the outer reached of the feet, extending the hub beyond the outer reaches of the feet, or extending the rotor beyond the outer reaches of the feet.

Figure 8:
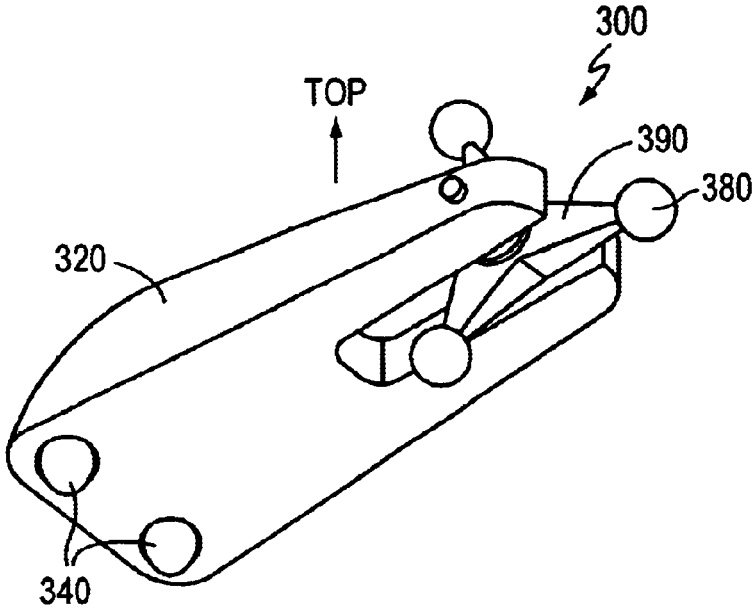
FIG. 8 shows yet another embodiment of the present invention.

Finally, FIG. 8 shows yet another embodiment of the present invention. In the FIG. 8, robot 300 includes a chassis 320, a single rotor 390, three feet 380, and two adhesive spots 340 located on the underside of the chassis 320. In other embodiments, the adhesive spots are merged into a single adhesive spot.

Although the description above contain many specificities, there should not be construed as limiting the scope of the invention but as merely providing illustrations of some of the presently preferred embodiments of this invention.

Other embodiments of the invention are within the scope of the following claims.

What is claimed is:

1. A wall-climbing robot comprising:

(a) a chassis, said chassis comprising a topside and an underside;

(b) a rotor attached to said chassis and rotatable with respect to the chassis, said rotor comprising a radial prominence;

(c) a foot attached to said prominence, said foot comprising means for adhering to a surface, the means for adhering comprising a pressure sensitive adhesive; and (d) an active drive means operatively connected to said rotor.

2. The wall-climbing robot of claim 1 further comprising an element attached to the underside of said chassis, said element comprising means for adhering to a surface.

3. The wall-climbing robot of claim 1 wherein said rotor further comprises a plurality of prominences.

4. The wall-climbing robot of claim 3 wherein said prominences are substantially equispaced around the rotor.

5. The wall-climbing robot of claim 3 further comprising a plurality of feet with a foot attached to each of said plurality of prominences.

6. The wall-climbing robot of claim 3, wherein said prominences are positioned at substantially equal radii around the axis of the rotor.

7. The wall-climbing robot of claim 5, wherein said feet are positioned at substantially equal radii around the axis of the rotor.

8. The wall-climbing robot of claim 1, wherein said means for adhering comprises an adhesive of polymerizing styrene, butadiene naphthenic oil, calcium carbonate, and hydrogenated polyterpene resin.

9. The wall-climbing robot of claim 1, wherein said rotor comprises a hub, a leg connected to said hub, and a foot connected to said leg.

10. The wall-climbing robot of claim 9, wherein said robot further comprises a plurality of legs and a plurality of feet.

11. The wall-climbing robot of claim 3, wherein a maximum of two prominences on said rotor are able to contact a surface at any time.

12. The wall-climbing robot of claim 5, wherein a maximum of two feet on said rotor are able to contact a surface at any time.

13. The wall-climbing robot of claim 1 further comprising a means for the remote control of said active drive means.

14. The wall-climbing robot of claim 1 wherein a foot contacts a surface over less than half of a revolution of the rotor.

15. A wall-climbing robot comprising:

(a) a chassis;

(b) a first rotor attached to said chassis and rotatable with respect to the chassis, said first rotor comprising a first radial prominence;

(c) a second rotor attached to said chassis and rotatable with respect to the chassis, said second rotor comprising a second radial prominence;

(d) a first foot attached to said first radial prominence, said first foot comprising means for adhering to a surface, the means for adhering comprising a pressure sensitive adhesive, and a second foot attached to said second radial prominence, said second foot comprising means for adhering to a surface, the means for adhering comprising a pressure sensitive adhesive; and (e) an active drive means operatively connected to said first rotor and to said second rotor.

16. The wall-climbing robot of claim 15, wherein said means for adhering comprises an adhesive of polymerizing styrene, butadiene naphthenic oil, calcium carbonate, and hydrogenated polyterpene resin.

17. The wall-climbing robot of claim 15, wherein said first rotor comprises a first plurality of prominences and a first plurality of feet attached to said first plurality of prominences, and said second rotor comprises a second plurality of prominences and a second plurality of feet attached to said second prominences.

18. A method of using the wall-climbing robot of claim 17, wherein no fewer than one foot on each of said first rotor and said second rotor contacts a surface at any time.

19. The wall-climbing robot of claim 17, wherein at least two feet of said first plurality of feet are able to contact a surface during a least a small arc of a revolution of said first rotor.

20. The wall-climbing robot of claim 19, wherein no more than two feet of the first plurality of feet contact a surface at any time.

21. The wall-climbing robot of claim 15 further comprising a means for the remote control of said active drive means.

22. The wall-climbing robot of claim 15 further comprising a means for the remote control of said active drive means.

23. The wall-climbing robot of claim 17, wherein said first plurality of prominences are equispaced around said first rotor.

24. The wall-climbing robot of claim 23 wherein said first plurality of feet are positioned at substantially equal radii around the axis of the first rotor.

25. The wall-climbing robot of claim 15 further comprising an axle attached to said chassis, wherein said first rotor is attached proximate to an end of said axle.

26. The wall-climbing robot of claim 25 wherein said second rotor is attached proximate to an end of said axle.

27. The wall-climbing robot of claim 15 further comprising a skid mounted to said chassis able to contact a surface.

28. The wall-climbing robot of claim 15 further comprising a roller connected to said chassis able to contact a surface.

29. The wall-climbing robot of claim 27, wherein said skid is substantially remote from said first rotor.

30. The wall-climbing robot of claim 28, wherein said roller is substantially remote from said first rotor.

31. A wall-climbing robot comprising:

(a) a chassis;

(b) a first rotor attached to said chassis and rotatable with respect to the chassis, said first rotor comprising a first radial prominence;

(c) a second rotor attached to said chassis and rotatable with respect to the chassis, said second rotor comprising a second radial prominence;

(d) a first foot attached to said first radial prominence, said first foot comprising means for adhering to a surface, the means for adhering comprising a pressure sensitive adhesive, and a second foot attached to said second radial prominence, said second foot comprising means for adhering to a surface, the means for adhering comprising a pressure sensitive adhesive; and (e) a first active drive means operatively connected to said first rotor, and a second active drive means operatively connected to said second rotor.

32. The wall-climbing robot of claim 31, wherein said means for adhering comprises an adhesive of polymerizing styrene, butadiene naphthenic oil, calcium carbonate, and hydrogenated polyterpene resin.

33. The wall-climbing robot of claim 31, wherein said first rotor comprises a first plurality of prominences and a first plurality of feet attached to said first plurality of prominences, and said second rotor comprises a second plurality of prominences and a second plurality of feet attached to said second prominences.

34. A method of using the wall-climbing robot of claim 33, wherein no fewer than one foot on each of said first rotor and said second rotor contacts a surface at any time.

35. The wall-climbing robot of claim 33, wherein at least two feet of said first plurality of feet are able to contact a surface during a least a small arc of a revolution of said first rotor.

36. The wall-climbing robot of claim 35, wherein no more than two feet of the first plurality of feet contact a surface at any time.

37. The wall-climbing robot of claim 31 further comprising a means for the remote control of said active drive means.

38. The wall-climbing robot of claim 31 further comprising a means for the remote control of said active drive means.

39. The wall-climbing robot of claim 33, wherein said first plurality of prominences are equispaced around said first rotor.

40. The wall-climbing robot of claim 39 wherein said first plurality of feet are positioned at substantially equal radii around the axis of the first rotor.

41. The wall-climbing robot of claim 31 further comprising an axle attached to said chassis, wherein said first rotor is attached proximate to an end of said axle.

42. The wall-climbing robot of claim 41 wherein said second rotor is attached proximate to an end of said axle.

43. The wall-climbing robot of claim 31 further comprising a skid mounted to said chassis able to contact a surface.

44. The wall-climbing robot of claim 31 further comprising a roller connected to said chassis able to contact a surface.

45. The wall-climbing robot of claim 43, wherein said skid is substantially remote from said first rotor.

46. The wall-climbing robot of claim 44, wherein said roller is substantially remote from said first rotor.

* * * * *